US011591150B2

(12) United States Patent
Maierhöfer et al.

(10) Patent No.: US 11,591,150 B2
(45) Date of Patent: Feb. 28, 2023

(54) CLOSURE DEVICE AND LIQUID CONTAINER

(71) Applicant: Robert Maierhöfer GbR, Eppingen (DE)

(72) Inventors: Robert Maierhöfer, Eppingen (DE); Benjamin Maierhöfer, Eppingen (DE)

(73) Assignee: Robert Maierhöfer GbR, Eppingen (DE)

( * ) Notice: Subject to any disclaimer, the term of this patent is extended or adjusted under 35 U.S.C. 154(b) by 94 days.

(21) Appl. No.: 16/865,935

(22) Filed: May 4, 2020

(65) Prior Publication Data

US 2020/0354132 A1 Nov. 12, 2020

(30) Foreign Application Priority Data

May 6, 2019 (EP) ..... 19172783

(51) Int. Cl.
*B65D 77/06* (2006.01)

(52) U.S. Cl.
CPC ..... *B65D 77/067* (2013.01)

(58) Field of Classification Search
CPC ..... B65D 75/008; B65D 77/067; B01L 3/505; A61J 1/10
USPC ..... 222/572, 573, 566, 95, 92
See application file for complete search history.

(56) References Cited

U.S. PATENT DOCUMENTS 5,899,624 A 5/1999 Thompson
2013/0292592 A1 11/2013 Py

FOREIGN PATENT DOCUMENTS

DE 10 2015 014 372 A1 5/2017
EP 3 042 861 A1 7/2016

OTHER PUBLICATIONS

Fallner, Translation of DE 102015014372, Dec. 4, 2021 (Year: 2021).*

* cited by examiner

*Primary Examiner* — Vishal Pancholi
*Assistant Examiner* — Robert K Nichols, II
(74) *Attorney, Agent, or Firm* — Foley & Lardner LLP

(57) ABSTRACT

The present invention relates to a closure device (10) for closing a liquid pouch, comprising: a base body (12) formed as a one-piece element, comprising a flat flange edge (14) for connecting the base body to the liquid pouch, and a portal structure (16) with a main section (18), a first valve section (20) and a second valve section (22), wherein the first valve section comprises a first opening (24) that is accessible from the outside and that is designed for inserting and withdrawing a fluid, and the second valve section comprises a second opening (26) that is accessible from the outside and that is designed for inserting and withdrawing a fluid; a first valve element (28) that is arranged within the first valve section for reversibly closing the first opening, and a second valve element (44) that is arranged within the second valve section for reversibly closing the second opening, wherein the first opening and the second opening are arranged parallel to the flange edge. The invention further relates to a liquid container comprising a liquid pouch and a closure device (10).

15 Claims, 5 Drawing Sheets

CLOSURE DEVICE AND LIQUID CONTAINER

CROSS-REFERENCE TO RELATED APPLICATION

This application claims priority to and the benefit of European Patent Application No. 19172783 entitled "Closure Device and Liquid Container", filed on May 6, 2019, the contents of which are incorporated by reference in their entirety.

TECHNICAL FIELD

The present invention relates to a closure device for closing a liquid pouch. The present invention further relates to a liquid container comprising a liquid pouch and a closure device.

BACKGROUND

In so-called bag-in-box packages a fluid is packed in a liquid pouch that in most cases consists of a composite film material (for example aluminum/HDPE or polyethylene). This liquid pouch is then placed in an outer packaging such as a carton or a wooden box. Withdrawal of the fluid is carried out through a withdrawal device that can for example be designed as a tap for manual withdrawal of the fluid. Another field of application of liquid pouches is the area of automated beverage dispensers. For soft drinks (Coke, lemonade etc.), for example, a syrup is mixed with water and carbonated so that it can be withdrawn in a drinkable form. In most cases, the syrup is supplied in a liquid pouch.

For filling in and withdrawing a fluid the liquid pouches must comprise openings. The opening is closed with a closure device that allows for the liquid pouch to be closed after filling and to be opened to withdraw fluid. In known approaches, a closure device is used in most cases that has an open lower part that is welded to the liquid pouch and an upper part that can be attached to the lower part. After filling has taken place through the lower part, the upper part is attached to the lower part so that the liquid pouch is closed.

However, this application of two-part closure devices has several disadvantages. On the one hand, sterilization or disinfection of the closure device during filling is complex and time-consuming. On the other hand, manufacturing a two-part closure device is comparatively complex and expensive, not least because more material is needed. Moreover, it is comparatively labor-intensive to fill the pouch through the lower part and subsequently assemble the lower and upper parts.

In order to improve the known approach of using two-part closure devices, DE 10 2015 014 372 A1 in this connection discloses a closure device with a closing bung designed as a flange component. The disclosed closure device is provided with a clamping flange just like the usual bung. Portals at the closure device fulfil the filling possibilities that have so far been provided by the bung hole. No longer is a closure device removed from a bung to fill a container, but filling material is brought into the container through the closure device itself via portals, which results in a closed filling and withdrawal system.

SUMMARY

A field of application of liquid pouches that has been neglected so far is the packaging of carbonated drinks. Such a packaging usually requires counterpressure filling. This means that a container that is under pressure is filled with a liquid, while at the same time a gas (usually $CO_2$) is released from the container. Counterpressure filling prevents foaming of the carbonated liquid. Due to their structure, known closure devices for liquid pouches are not suitable for counterpressure filling.

On this basis, the present invention addresses the problem of providing a closure device that can also be used in counterpressure filling. In particular, a closure device shall be provided that allows for efficient automated counterpressure filling so that a packaging of carbonated liquids in liquid pouches is made possible. In addition, efficient producibility, easy disinfection as well as sufficient stability against higher pressures shall be achieved. For example, a pressure of up to 10 bar can occur if the liquid in the pouch is shocked or heated. To solve this problem, the present invention in one aspect relates to a closure device for closing a liquid pouch, comprising:

- a base body formed as a one-piece element, comprising a flat flange edge for connecting the base body to the liquid pouch, and a portal structure with a main section, a first valve section and a second valve section, wherein the first valve section comprises a first opening that is accessible from the outside and that is designed for inserting and withdrawing a fluid, and the second valve section comprises a second opening that is accessible from the outside and that is designed for inserting and withdrawing a fluid;
- a first valve element that is arranged within the first valve section for reversibly closing the first opening, and a second valve element that is arranged within the second valve section for reversibly closing the second opening, wherein
- the first opening and the second opening are positioned parallel to the flange edge.

In another aspect, the present invention further relates to a liquid container comprising a liquid pouch and a closure device as defined above.

Preferred embodiments of the invention are described in the dependent claims. It is understood that the features mentioned hereinbefore and those to be commented on hereinafter may be used not only in the specified combination but also in other combinations or in isolation without departing from the scope of the present invention. In particular, the liquid container can be designed in accordance with the embodiments of the closure device described in the dependent claims.

According to the invention, the use of a base body is suggested that is formed as a one-piece element and has two openings that are accessible from the outside. A liquid can be filled in through one of the openings, while a gas can be released through the other opening. The openings each form the end of a valve section inside of each of which a valve element is arranged. The valve elements make sure that liquid or gas (fluid) can only be filled in or withdrawn in a controlled manner. The valve elements close the openings but can also be brought in an open position in which the openings are open. The two valve elements function separately or independently from one another so that it is possible to open one opening while the other opening is closed. By means of the flange edge, the closure device can be connected to a liquid pouch, for example by welding.

According to the invention, the first opening and the second opening are positioned parallel to the flange edge. The preferably circular openings are arranged in a plane that is parallel to the plane of the flange edge. The closure device according to the invention is thus suitable for use in counterpressure filling. It is rendered possible that a filling machine can efficiently approach both openings at the same time to carry out counterpressure filling. The orientation of the openings parallel to the flange edge allows for the closure device or the liquid container, respectively, to be inserted into a filling machine. The orientation of the two openings according to the invention in connection with a base body that is formed as a one-piece element results in an efficient applicability of the closure device according to the invention in the area of counterpressure filling. In particular, it is possible to fill a liquid container according to the invention with carbonated drinks. Moreover, the construction according to the invention allows for a high stability against liquids in the pouch that are under pressure. In contrast to known closure devices, the invention thus allows for a cost-effective transport of carbonated drinks such as beer.

In a preferred embodiment, the first valve element comprises a tappet, which is mounted movably perpendicular to the flange edge, and a spring. The spring exerts a closing force on the tappet. By means of the closing force, a closing section of the tappet is pushed against a first closing edge within the first valve section for closing the first opening. The spring is compressible by an external application of force on the tappet, by means of which the tappet can be released from the first closing edge for opening the first opening. The spring is preferably designed as a coil spring. The closing edge is preferably positioned parallel to the flange edge. The use of a spring in connection with a tappet allows for an efficient application of the first valve element. Reliable sealing is achieved. The use of a tappet in connection with a coil spring allows for a long life span with a plurality of opening and closing procedures. Thus, the first opening can, for instance, be designed so that a beverage can be withdrawn by means of a corresponding tap with a device for exerting pressure on the tappet. Moreover, sufficient stability even at high pressures is guaranteed.

In a preferred embodiment, the tappet comprises a guide pin in its closing section for guiding the tappet when the external force is applied, which guide pin is accessible from the outside of the first valve section through the first opening. The guide pin preferably has a cylindrical form. In addition or alternatively, the guide pin does not project above a side of the first valve section facing away from the flange edge. The guide pin allows for a controlled movement of the tappet when filling in and withdrawing a fluid. In a corresponding filling device, the tappet can be gripped or guided in order to fill in gas, for instance, in a controlled process. The cylindrical form of the guide pin allows for a simple automatic alignment. The fact that the guide pin does not project above the valve section serves to prevent a destruction and/or defect.

In a further advantageous embodiment, the closure device comprises a guide element that is arranged within the first valve section for guiding a movement of the tappet. The guide element is preferably designed to support the spring during exertion of the closing force. In addition or alternatively, the guide element abuts on three points on an inside of the first valve section. The use of a guide element further improves the stability of the first valve. This leads to increased stability particularly at high pressures. It is ensured that the liquid pouch remains safely closed even if the pressure inside it rises. The fact that the spring is at the same time supported ensures an efficient and cost-saving producibility. Mounting on three points results in a tight fit.

In a preferred embodiment, the closure device comprises a sealing element that is arranged within the first valve section between the closing section of the tappet and the first closing edge and that is designed for closing the first opening. The sealing element is preferably designed as a sealing washer. The sealing element helps to further improve the reliability of the closure of the first opening. This is particularly advantageous when the pressure inside the liquid pouch increases. It is made sure that the first opening is closed even if the elastic force of the spring should decrease over its life span. The use of a sealing washer results in a cost-efficient implementation.

In a further advantageous embodiment, the second valve element is formed in one piece from elastic plastic material and comprises a spring section that exerts a closing force on a plane end section of the second valve element. By means of the closing force, the end section is pressed against a second closing edge within the second valve section for closing the second opening. The spring section is compressible by an external application of force on the second valve element, by means of which force the end section can be released from the second closing edge for opening the second opening. Preferably, the spring section comprises a plurality of elastic struts which are inclined against a direction perpendicular to the flange edge. The fact that the second valve element is designed in one piece from elastic plastic material allows for a cost-efficient realization. In most cases it is sufficient if one of the two openings can be opened and closed merely a few times during filling. It is insofar sufficient to use a one-piece valve element, which is made from elastic plastic material, can be realized in a cost-efficient manner and is reliable for a few closure procedures. The use of inclined elastic struts nevertheless ensures a sufficient closing force, which allows for reliable closing of the second opening, even if the pressure inside the pouch increases.

In a preferred embodiment, the closure device comprises a mounting strap that is designed for removable coupling to protrusions in an area of the second valve section facing the flange edge to secure the second valve element within the second valve section. A mounting strap is a cost-efficient possibility for securing the second valve element. This results in sufficient stability and efficient producibility at the same time.

In a preferred embodiment, the main section is designed cylindrically. In addition or alternatively, the main section comprises a gripping element in its circumference for retaining the closure device in a desired orientation. Further additionally or alternatively, the main section comprises a circumferential protrusion that is oriented parallel to the flange edge on a side facing away from the flange edge. Further additionally or alternatively, the main section comprises a circumferential web at the connection to the flange edge. The cylindrical design results in an easy manageability in an automated filling device. The gripping element can interact with corresponding elements in the filling device to allow for reliable and time-saving filling, in particular counterpressure filling. The protrusion allows for improved securing of the closure device during filling. The circumferential web helps to increase stability in the area of the coupling to the flange edge. It is also made sure that when the closure device is connected to the liquid pouch, for example by welding, a sufficient material thickness comes into contact with the liquid pouch to ensure a reliable connection.

In a preferred embodiment, the first valve section is designed cylindrically. In addition or alternatively, the first valve section projects above the main section perpendicular to the flange edge. Further additionally or alternatively, at an outer side, the first valve section comprises a circumferential recess and an adjacent circumferential protrusion for coupling the first valve section to a filling and/or withdrawal device. Preferably, the circumferential recess and the circumferential protrusion have a frustoconical cross-section. The cylindric design allows for efficient coupling to a corresponding nozzle of a filling and/or withdrawal device. Such a filling and/or withdrawal device interacts with the recess and the protrusion so that carbonated drinks can be filled in by means of counterpressure filling. It is prevented that the first valve section comes loose during filling. A frustoconical cross-section of the recess and/or the protrusion allows for an alignment.

In a further preferred embodiment, the closure device comprises a circumferential receptacle at an outer side of the first valve section for receiving a sealing ring. By means of the sealing ring reliable sealing even at increased pressures is achieved.

In a further preferred embodiment, the flange edge is designed annularly. An annular flange edge allows for easy positioning of the closure device in relation to the pouch during welding. Producibility remains efficient.

Preferably, the base body is designed as an injection-molded piece. Injection-molded pieces can be manufactured efficiently and at low cost.

In a preferred embodiment of the liquid pouch, the flange edge of the closure device is welded to the liquid pouch. A welding connection ensures secure closing even at higher pressures.

Herein, a base body formed as a one-piece element is in particular understood to mean a single injection-molded piece that can be manufactured in a corresponding injection molding process. Reversible closing is understood to mean a closing that allows for subsequent opening and reclosing. An opening that is accessible from the outside is an opening that is accessible by a filling and/or withdrawal device when the closure device is gripped by such a device. A fluid is a gas or a liquid.

DESCRIPTION OF THE DRAWINGS

The invention is described and explained in more detail by means of a number of selected exemplary embodiments in connection with the enclosed Figures hereinafter. In the Figures.

DETAILED DESCRIPTION

Figure 1:
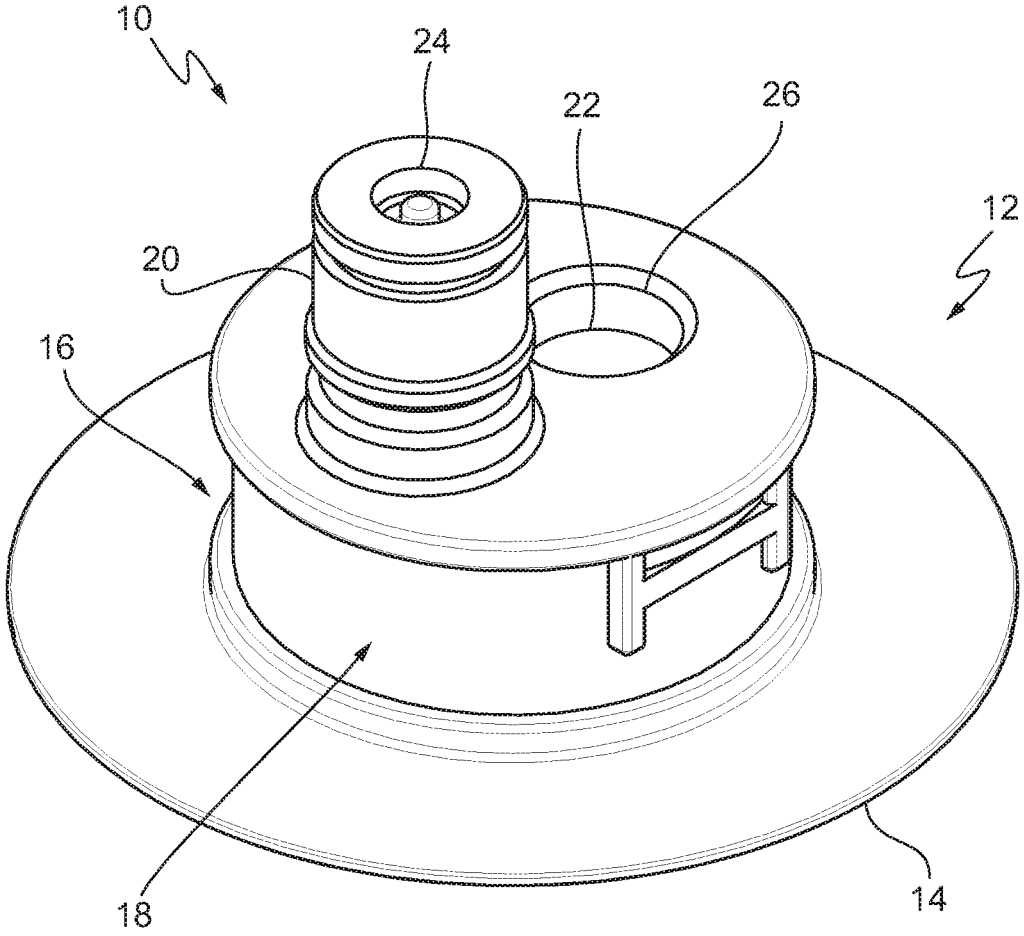
FIG. 1 shows a schematic perspective view of a closure device according to the invention.

FIG. 1 schematically illustrates a closure device 10 according to the invention in a perspective view. The closure device 10 serves to close a liquid pouch and forms a liquid container together with the liquid pouch. Such liquid containers are for example used in bag-in-box systems or for storing and/or transporting syrup formulations for beverage machines. The closure device 10 according to the invention is particularly suitable for liquid pouches which are to be filled with carbonated fluids. Carbonated liquids such as beer etc. exert a comparatively high force on the liquid pouch as well as on the closure device, as a pressure of 10 bar or more can arise within the liquid pouch. This is particularly true if the liquid pouch is exposed to direct sunshine or its contents start foaming because of vibrations. Moreover, counterpressure filling has to be possible.

The closure device 10 according to the invention is welded to the liquid pouch. For that purpose, a base body 12 of the closure device 10 comprises a flange edge 14. The flange edge 14 is plane and flat and is attached (welded) to the liquid pouch. Welding to the liquid pouch is carried out before the pouch is filled.

The base body 12 is designed as a one-piece injection-molded element. The base body 12 further comprises a portal structure 16, which in turn is formed by a main section 18, a first valve section 20 as well as a second valve section 22. The first valve section 20 comprises a first opening 24 that is accessible from the outside, the second valve section 22 comprises a second opening 26 that is accessible from the outside. The first opening 24 and the second opening 26 are positioned parallel to the flat flange edge 14. The orientation of the first opening 24 and the second opening 26 parallel to the flange edge 14 ensures accessibility in a filling and/or withdrawal device.

When counterpressure filling the liquid pouch, the pouch is first filled with a gas that is usually brought in through the first opening 24. The liquid pouch that is now under pressure is then filled with liquid, while at the same time the gas is released. Due to the larger cross-section, the liquid is in most cases filled in through the second opening 26. Since the pressure inside the liquid pouch is kept constant, carbonated liquid can be filled in.

Figure 2:
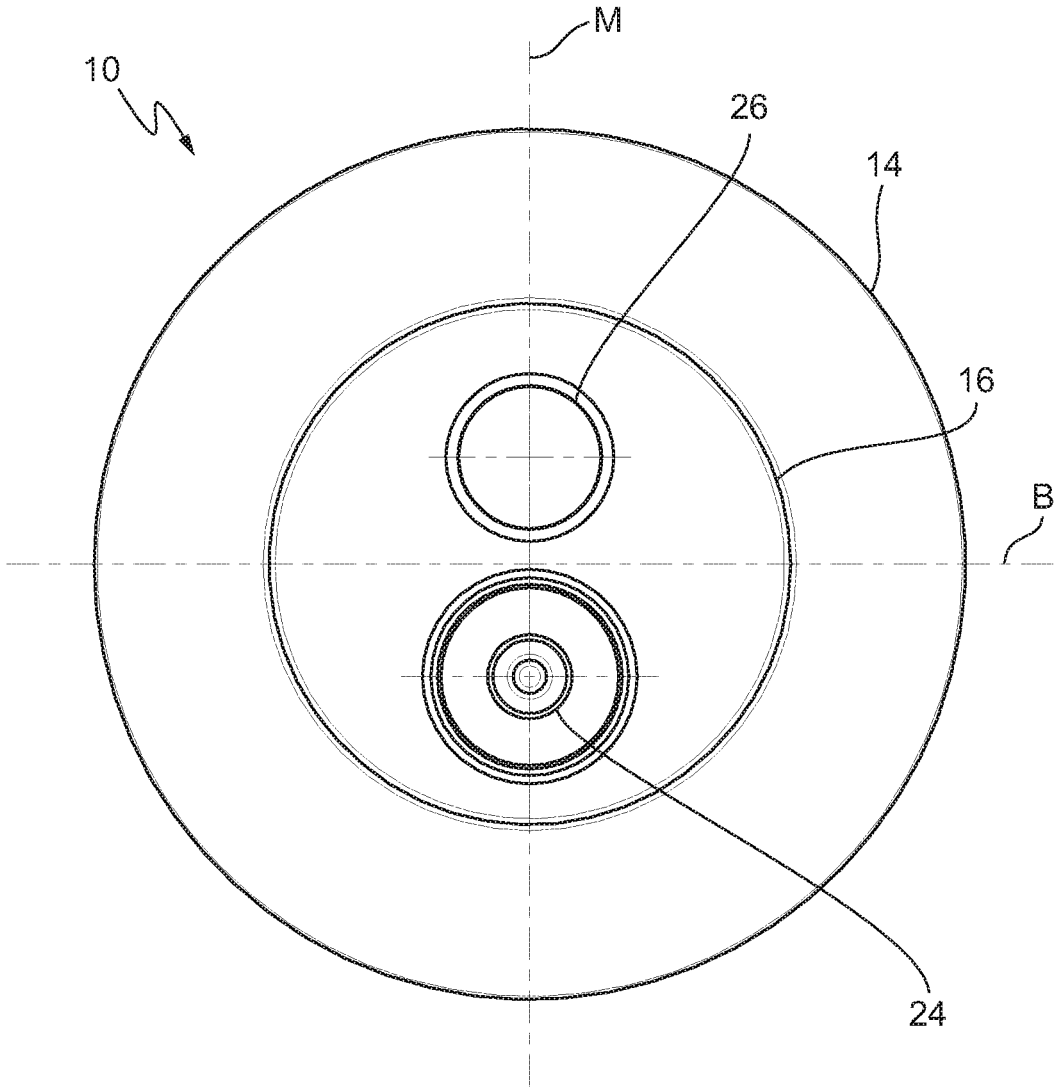
FIG. 2 shows a top view of the closure device according to the invention.

FIG. 2 illustrates a schematic top view of the closure device 10. The flange edge 14 is essentially designed annularly. The first opening 24 and the second opening 26 are located on a middle axis M of the closure device 10 on both sides of a width axis B. The portal structure 16 is also essentially cylindrical in shape and in the illustrated view is arranged concentrically with respect to the flange edge 14.

Figure 3A:
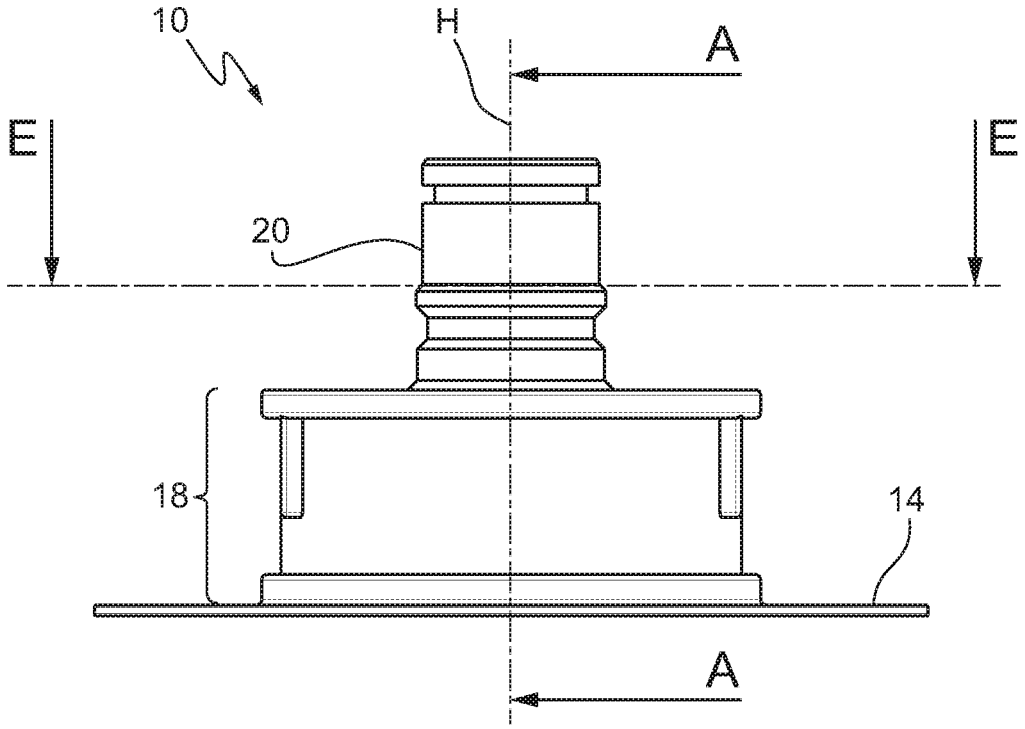
FIG. 3*a* shows a side view of the closure device.
Figure 3B:
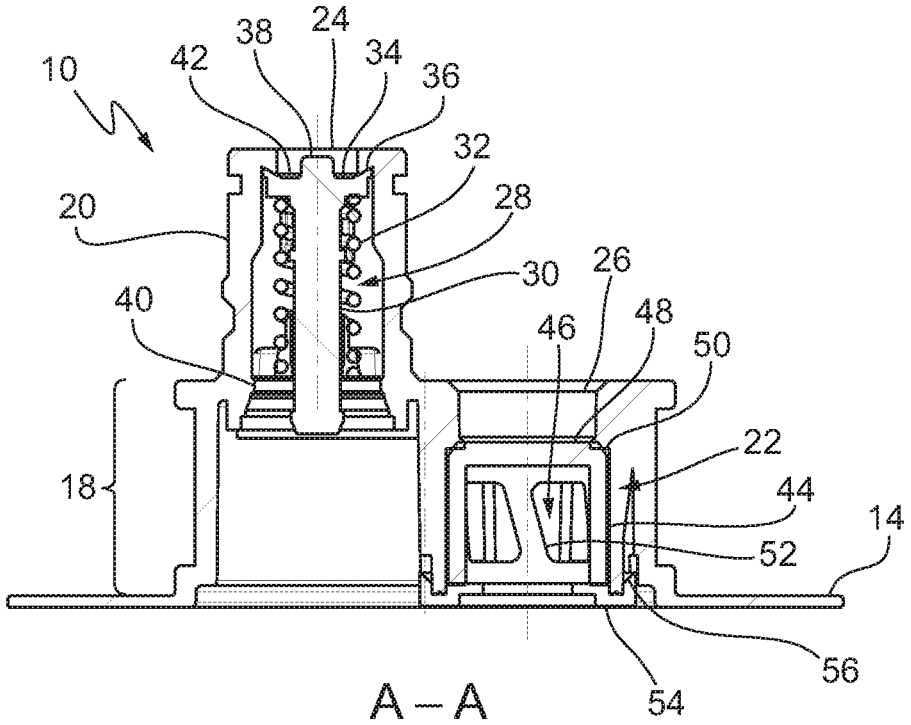
FIG. 3*b* shows a sectional view from the side of the closure device.

FIG. 3*a* illustrates a schematic side view, wherein a sectional plane A is drawn in that runs through a height axis H. FIG. 3*b* shows the corresponding sectional view.

The first valve section 20 is essentially designed cylindrically and projects above the main section 18 perpendicular to the flange edge 14. The second valve section 22 is arranged within the main section 18.

A first valve element 28 is arranged within the first valve section 20, which valve element, in the exemplary embodiment shown, comprises a movably mounted tappet 30 as well as a spring 32. The spring 32 exerts a closing force on the tappet 30. In the illustrated view, the tappet 30 is pushed up by the spring 32, wherein a closing section 34 of the tappet 30 is pushed against a first closing edge 36 within the first valve section 20. The first closing edge 36 corresponds to an annular protrusion in a radial direction. The closing section 34 is essentially designed circularly, wherein the circle has a larger cross-section than the inner circle of the first closing edge 36. For opening the first opening 24, a pressure can be exerted on the tappet 30 from outside (above) so that the closing section 34 is released from the closing edge. This allows for a fluid flow through the first valve section 20. Since an inner cross-section of the first valve section 20 is larger than a cross-section of the tappet 30 in the area of its closing section 34, a fluid can flow past the tappet into or out of the liquid pouch. In the illustrated exemplary embodiment, the tappet 30 further comprises a guide pin 38 that is accessible from the outside and serves to guide the tappet 30 when the external force is applied. In the illustrated exemplary embodiment, the guide pin 38 of the tappet 30 has a cylindrical form and does not project above the first valve section 20 on a side facing away from the flange edge 14. The guide pin 38 can be gripped, as it were, in a filling and/or withdrawal device to open and close the first valve element 28. The cylindrical form of the guide pin 38 allows for an easy alignment. The guiding done by the guide pin 38 prevents the tappet from getting caught within the first valve section 20 when the first opening 24 is closed, which would make it impossible to close the first opening 24.

The counterpressure on the spring 32, which is preferably designed as a coil spring, is exerted by a guide element 40 on which the spring 32 is mounted. The tappet 30 is guided by the guide element 40.

For a better closing of the first opening, a sealing element 42 can be provided between the first closing edge 36 and the closing section 34 of the tappet 30, which is designed as a sealing washer in the illustrated exemplary embodiment. The sealing washer serves to prevent fluid from ingressing or leaking when the first valve element 28 is in a closed position. Use of the sealing washer results in an improved long-term leak tightness.

A second valve element 44, which serves to reversibly close the second opening 26, is arranged within the second valve section 22. In the illustrated exemplary embodiment, the second valve element 44 is formed in one piece from elastic plastic material. It comprises a spring section 46, which exerts a closing force on a plane end section 48 of the second valve element 44, by which force the end section 48 is pressed against a second closing edge 50 within the second valve section 22. The end section 48 is essentially plane and circular in its design, wherein the cross-section of the end section 48 is larger than the cross-section of the inner circle of the circular ring formed by the second closing edge 50. For exerting the spring force, the spring section 46 comprises a plurality of elastic struts 52 that can be compressed under pressure. When the end section 48 of the second valve element 44 is released from the second closing edge 50, fluid can flow through the second opening 26. For example, a liquid can be filled in.

A detachable mounting strap 54 is provided for securing the second valve element 44 within the second valve section 22. The mounting strap can be secured at mounting protrusions 56 in an area of the second valve section 22 that faces the flange edge 14. Thus, the second valve element 44 can be secured within the second valve section 22. When the closure device 10 according to the invention is assembled, the second valve element 44 can therefore be inserted from below into the second valve section 22 in the illustration shown. The mounting strap 54 is then coupled to the mounting protrusions 56 to absorb the counterforce for exerting the closing force between end section 48 and second closing edge 50. The mounting strap 54 is preferably also designed as an injection-molded piece.

Figure 4:
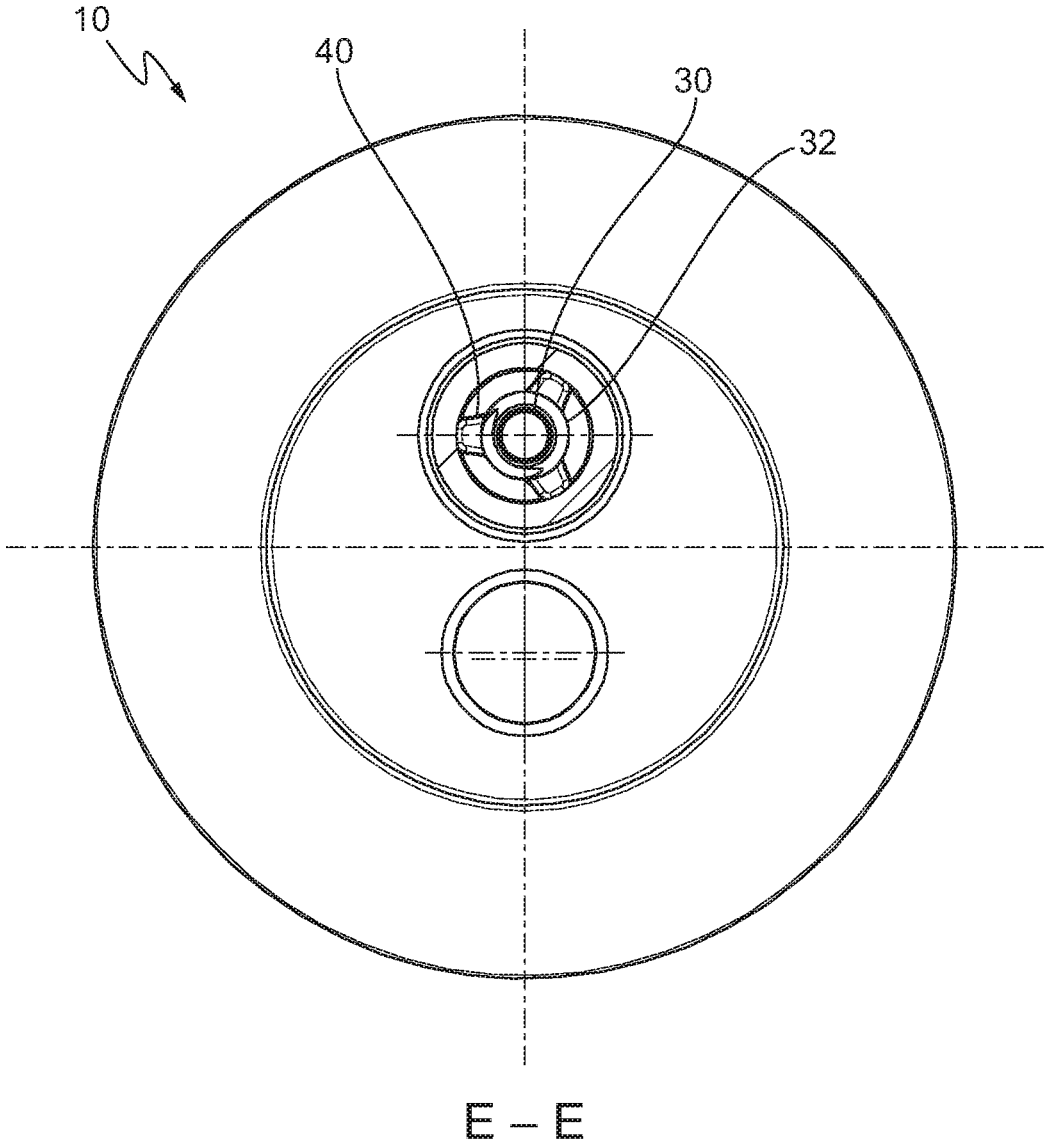
FIG. 4 shows a schematic sectional view in a plane parallel to the flange edge.

FIG. 4 schematically illustrates another sectional view in a plane perpendicular to the height axis H or parallel to the width axis B and the middle axis M in the area of the guide element 40. The sectional plane E is drawn in in FIG. 3*a*. As illustrated, the guide element 40 is supported at three points on an inside of the first valve section 20 for guiding the movement of the tappet 30 and for supporting the spring 32.

Figure 5:
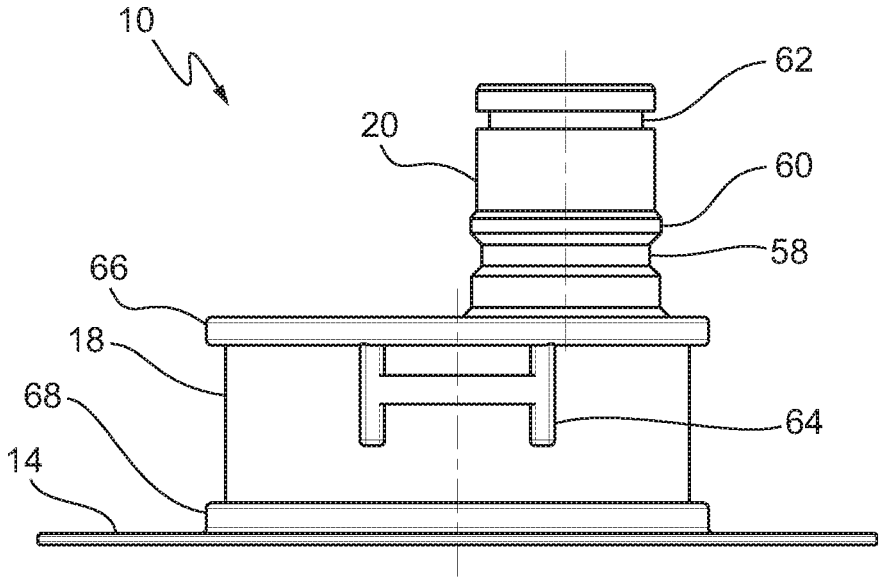
FIG. 5 shows a schematic side view.

FIG. 5 schematically illustrates another side view of the closure device 10 according to the invention. On its outer side, the first valve section 20 has a circumferential recess 58 as well as an adjacent circumferential protrusion 60 for coupling with a corresponding nozzle of a filling and/or withdrawal device. Both the circumferential recess 58 and the circumferential protrusion 60 have a frustoconical cross-section. It is possible to grip the closure device 10 in the area of the first valve section 20 at the circumferential recess and/or at the circumferential protrusion 60 in order to carry out a filling and/or withdrawal process, even under pressure. In addition, the closure device 10 comprises a circumferential receptacle 62 that essentially has a rectangular cross-section. The receptacle 62 serves to receive a sealing ring to achieve sealing during the filling and/or withdrawal process.

To secure the entire closure device 10 during the filling and/or withdrawal process, the main section 18, which is essentially designed cylindrically, in its circumference comprises a gripping element 64 for fixing the closure device 10 in a predefined orientation in respect of a rotation.

Moreover, the main section 18 is limited on its side facing away from the flange edge 14 by a protrusion 66 that is oriented parallel to the flange edge 14. This protrusion also serves to reliably secure the closure device 10 in a filling and/or withdrawal device. The protrusion 66 makes it possible to grip the closure device 10.

In the area of the connection to the flange edge 14, the main section 18 further comprises a circumferential web 68 that serves to increase the stability of the connection between main section 18 and flange edge 14. This also results in an easier coupling to the liquid pouch.

Figure 6:
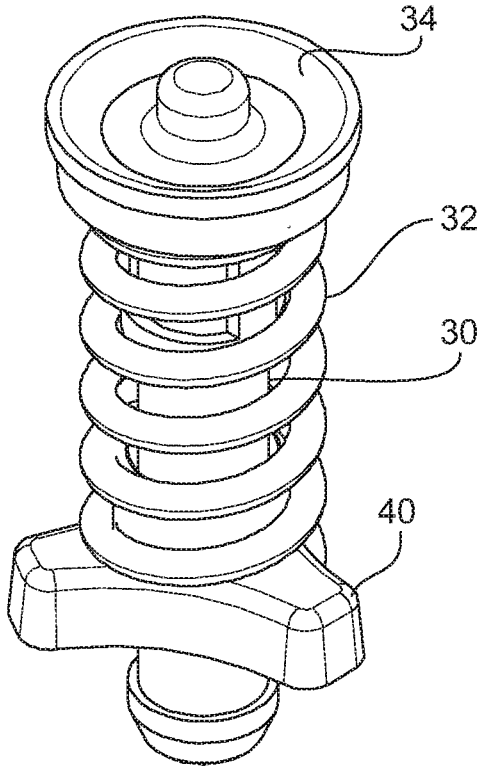
FIG. 6 shows a schematic perspective view of the first valve element.

FIG. 6 schematically illustrates a perspective view of the first valve element 28 with the tappet 30 and the spring 32 as well as of the guide element 40. The closing section 34 of the tappet 30 is essentially designed circularly. The spring 32 rests on the guide element 40 and the tappet 30 is guided by the guide element 40.

The invention has been comprehensively described and explained by means of the Figures and the description. The description and explanations are to be regarded as examples and not as limiting the scope. The invention is not limited to the disclosed embodiments. For the person skilled in the art, other embodiments or variants follow from the use of the present invention as well as from a thorough analysis of the drawings, the description and the following patent claims.

In the patent claims, the words "comprise" and "having" do not exclude the presence of further elements or steps. The indefinite article "a" or "an" does not exclude the presence of a plural. A single element or a single unit may execute the functions of several of the units named in the patent claims. The mere mention of some measures in several different dependent patent claims is not to be understood to the effect that a combination of these measures cannot also be used advantageously. Reference numerals in the patent claims are not to be understood as limiting the scope of the invention.

REFERENCE NUMERALS

10 closure device
12 base body
14 flange edge
16 portal structure
18 main section
20 first valve section
22 second valve section
24 first opening
26 second opening

28 first valve element
30 tappet
32 spring
34 closing section
36 first closing edge
38 guide pin
40 guide element
42 sealing element
44 second valve element
46 spring section
48 end section
50 second closing edge
52 strut
54 mounting strap
56 mounting protrusion
58 circumferential recess
60 circumferential protrusion
62 circumferential receptacle
64 gripping element
66 protrusion
68 web

What is claimed is:

1. A closure device for closing a liquid pouch, comprising:

a base body formed as a one-piece element, comprising a flat flange edge for connecting the base body to the liquid pouch, and a portal structure with a main section, a first valve section and a second valve section, wherein the first valve section comprises a first opening that is accessible from the outside configured for inserting and withdrawing a fluid, and the second valve section comprises a second opening that is accessible from the outside and configured for inserting and withdrawing a fluid;

a first valve element that is arranged within the first valve section for reversibly closing the first opening, and a second valve element that is arranged within the second valve section for reversibly closing the second opening, wherein wherein the first valve section is designed cylindrically, and at an outer side, comprises a circumferential recess and an adjacent circumferential protrusion for coupling the first valve section with a filling and/or withdrawal device, wherein the circumferential recess and the circumferential protrusion have a frustoconical cross-section, and the first opening and the second opening are arranged parallel to the flange edge.

2. The closure device according to claim 1, wherein the first valve element comprises a tappet, which is mounted movably perpendicular to the flange edge, and a spring;

the spring exerts a closing force on the tappet, by which a closing section of the tappet is pushed against a first closing edge within the first valve section for closing the first opening;

the spring is compressible by an external application of force on the tappet, by which the tappet can be released from the first closing edge for opening the first opening; and the spring is designed as a coil spring and/or the closing edge is arranged parallel to the flange edge.

3. The closure device according to claim 2, wherein the tappet comprises a guide pin in its closing section for guiding the tappet when the external force is applied, which guide pin is accessible from the outside of the first valve section through the first opening; and the guide pin has a cylindrical form and/or does not project above a side of the first valve section facing away from the flange edge.

4. The closure device according to claim 2, comprising a guide element that is arranged within the first valve section and that is designed for guiding a movement of the tappet, wherein the guide element is designed to support the spring during exertion of the closing force and/or abuts on three points on an inner side of the first valve section.

5. The closure device according to claim 2, comprising a sealing element that is arranged within the first valve section between the closing section of the tappet and the first closing edge and that is designed for closing the first opening, wherein the sealing element is designed as a sealing washer.

6. The closure device according to claim 1, wherein the second valve element is formed in one piece from elastic plastic material and comprises a spring section, which exerts a closing force on a plane end section of the second valve element, by which force the end section is pressed against a second closing edge within the second valve section for closing the second opening;

the spring section is compressible by an external application of force on the second valve element, by which force the end section can be released from the second closing edge for opening the second opening; and the spring section comprises a plurality of elastic struts which are inclined against a direction perpendicular to the flange edge.

7. The closure device according to claim 6, comprising a mounting strap that is designed for removable coupling to protrusions in an area of the second valve section facing the flange edge to secure the second valve element within the second valve section.

8. The closure device according to any claim 1, wherein the main section is designed cylindrically;

in its circumference comprises a gripping element for retaining the closure device in a desired orientation;

comprises a circumferential protrusion that is oriented parallel to the flange edge on a side facing away from the flange edge; and/or comprises a circumferential web at the connection to the flange edge.

9. The closure device according to claim 1, wherein the first valve section projects above the main section perpendicular to the flange edge.

10. The closure device according to claim 1, comprising a circumferential receptacle at an outer side of the first valve section for receiving a sealing washer.

11. The closure device according to claim 1, wherein the second valve section is arranged within the main section.

12. The closure device according to claim 1, wherein the flange edge is designed annularly.

13. The closure device according to claim 1, wherein the base body is designed as an injection-molded piece.

14. A liquid container comprising a liquid pouch and a closure device according to claim 1.

15. The liquid container according to claim 14, wherein the flange edge of the closure device is welded to the liquid pouch.

* * * * *